United States Patent [19]

Fyfe et al.

[11] Patent Number: 4,630,364

[45] Date of Patent: Dec. 23, 1986

[54] APPARATUS FOR APPLYING FASTENER TAPE TO FABRIC PIECES

[75] Inventors: Leo W. Fyfe, Nashville; A. Matthew Seaman, Brentwood, both of Tenn.

[73] Assignee: Cutters Exchange, Inc., Nashville, Tenn.

[21] Appl. No.: 729,258

[22] Filed: May 1, 1985

[51] Int. Cl.[4] ..... B23P 21/00

[52] U.S. Cl. ..... 29/779; 29/238; 29/430; 29/450; 29/787; 29/795; 29/797; 112/104; 112/113; 112/121.27; 112/121.29

[58] Field of Search ..... 29/91, 91.1, 91.6, 91.7, 29/400 C, 400 RL, 429, 430, 33.5, 779, 728, 783, 791, 786, 793, 787, 794, 790, 795, 797, 819, 238, 243.5, 243.57, 243.58, 450, DIG. 11; 428/100, 102; 112/104, 106, 113, 121.11, 121.27, 2, 121.29; 24/31, 306

[56] References Cited

U.S. PATENT DOCUMENTS

| | | | |
|---|---|---|---|
| 2,767,532 | 10/1956 | Bossi | 29/450 |
| 3,008,507 | 11/1961 | Schneider | 29/238 X |
| 3,244,129 | 4/1966 | Steingruebner | 112/113 X |
| 3,263,305 | 8/1966 | Butler et al. | 29/400 RL |
| 3,782,309 | 1/1974 | Lee | 112/121.29 |
| 3,853,671 | 12/1974 | Ausnit | 428/100 X |
| 4,530,295 | 7/1985 | Adamski et al. | 112/121.29 X |

FOREIGN PATENT DOCUMENTS

| | | | |
|---|---|---|---|
| 571272 | 3/1959 | Belgium | 29/429 |
| 3042382 | 6/1981 | Fed. Rep. of Germany | 29/91 |
| 1406822 | 9/1975 | United Kingdom | 112/121.27 |

*Primary Examiner*—Mark Rosenbaum
*Assistant Examiner*—Joseph M. Gorski
*Attorney, Agent, or Firm*—Harrington A. Lackey

[57] ABSTRACT

An apparatus for securing a pair of elongated cooperative interlocking tapes to the corresponding edges of a pair of fabric pieces, for guiding the edge portions of the fabric pieces to an overlapping vertically aligned position, and for pulling and compressing the overlapping portions into interlocking engagement. The apparatus is particularly adaptable for stitching cooperative tapes of "Velcro" to the opposed edges of fabric pieces, such as the margins of an opening in an edge panel in a sofa cushion cover. The overlapping edges with their opposed tapes are compressed into interlocking relationship so that the edges may be retained closed when the fabric pieces are subsequently stitched to other fabric pieces to complete a sofa cushion cover.

8 Claims, 12 Drawing Figures

APPARATUS FOR APPLYING FASTENER TAPE TO FABRIC PIECES

BACKGROUND OF THE INVENTION

This invention relates to a method and apparatus for applying fastener tape to a pair of opposed fabric pieces, and more particularly to an apparatus for securing fastener tapes to overlapping edges of a pair of fabric pieces.

In the manufacture of fabric products having elongated openings, adapted to be opened and closed, slide fasteners, such as the "zipper", are sewn to the opposed edges of each opening. Usually, a pair of fabric pieces are fed co-planar, side-by-side, along with a closed slide fastener, beneath a stitching head. The stitching head sews the slide fastener to the opposed edges of the fabric pieces, Since the slide fastener is already closed, no guide elements are required to bring the slide fastener elements into cooperative engagement.

The above method of attaching slide fastener elements to the opposed edges of an opening in a fabric product, is utilized in the manufacture of sofa cushion covers. After the slide fastener elements are stitched to a pair of opposed fabric pieces, the fabric pieces are then subsequently stitched to other fabric pieces which comprise the complete cushion cover. However, slide fasteners, particularly, "zippers" are sometimes difficult to operate, and occasionally jam, fail, or injure the operator's fingers, when attempting to open and close the opening to the cushion cover for insertion or removal of the cushion.

One type of fastener which is sometimes used for the fastening and securing together of apparel pieces is a fastener tape known in the trade as "Velcro", marketed by the Velcro Corporation. The "Velcro" tape fastener includes a pair of elongated flat tapes having opposed cooperative surfaces. One of the surfaces is formed of a plurality of very small multiple loops, and the other cooperative surface is covered with a myriad of finely woven monofilaments formed into permanent hooks adapted to cooperate with the loops on the opposite facing surface when the opposed cooperative surfaces are pressed together. The cooperative surfaces incorporating the interlocking hooks and loops form a very strong bond against opposing shear forces, that is forces acting parallel to the plane of the cooperative surfaces. However, the surfaces may easily be released by pulling one surface away from the other in a "peeling" action.

SUMMARY OF THE INVENTION

It is therefore an object of this invention to provide a method and apparatus for attaching a pair of fastener tapes, having cooperative interlocking surfaces, to the opposed edges of a pair of fabric pieces, subsequently guiding the taped edges of the fabric pieces in an overlapping relationship, and pressing the opposed tapes into interlocking engagement.

Another object of this invention is to provide a sewing head for stitching cooperative fastener tapes simultaneously to the opposed edges of a pair of fabric pieces, while the fabric pieces are moving substantially co-planar through the sewing machine, subsequently guiding the taped edges into overlapping relationship, one above the other, and then passing the overlapping fabric pieces beneath a pair of puller rollers which compress the opposed faces of the fastener tapes into interlocking relationship The preferred form of the fastener tapes having the cooperative surfaces are "Velcro" tapes having the cooperative hooks and loops in the opposed surfaces of the tapes.

Another object of this invention is to provide a method and apparatus for securing, in overlapping relationship, the opposed edges of a pair of fabric pieces having elongated fastener tapes including a pair of opposed cooperative surfaces, comprising a pair of adjustable, overlapping channel-shaped guide members for guiding the taped edges from a substantially co-planar side-by-side position to an overlapping vertically aligned position.

Another object of this invention is to provide a method and apparatus for securing, in overlapping relationship, the opposed edges of a pair of fabric pieces having opposed fastener tapes with interlockinq cooperative surfaces, whereby the opposed taped edges are guided in overlapping convergent paths, and pressed together to hold the edges in interlocking engagement for subsequent stitching to the fabric panels used in the fabrication of a sofa cushion cover.

Another object of this invention is to provide a method and apparatus for making a closure panel for a sofa cushion cover, incorporating fastener tapes of the "Velcro" type, in lieu of slide fasteners, such as "zippers".

DESCRIPTION OF THE PREFERRED EMBODIMENTS

Figure 12:
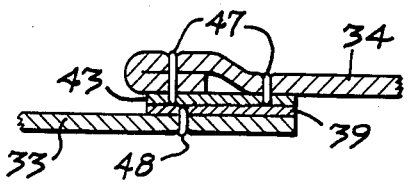
FIG. 12 is an enlarged fragmentary section taken along the line 12—12 of FIG. 1.
Figure 1:
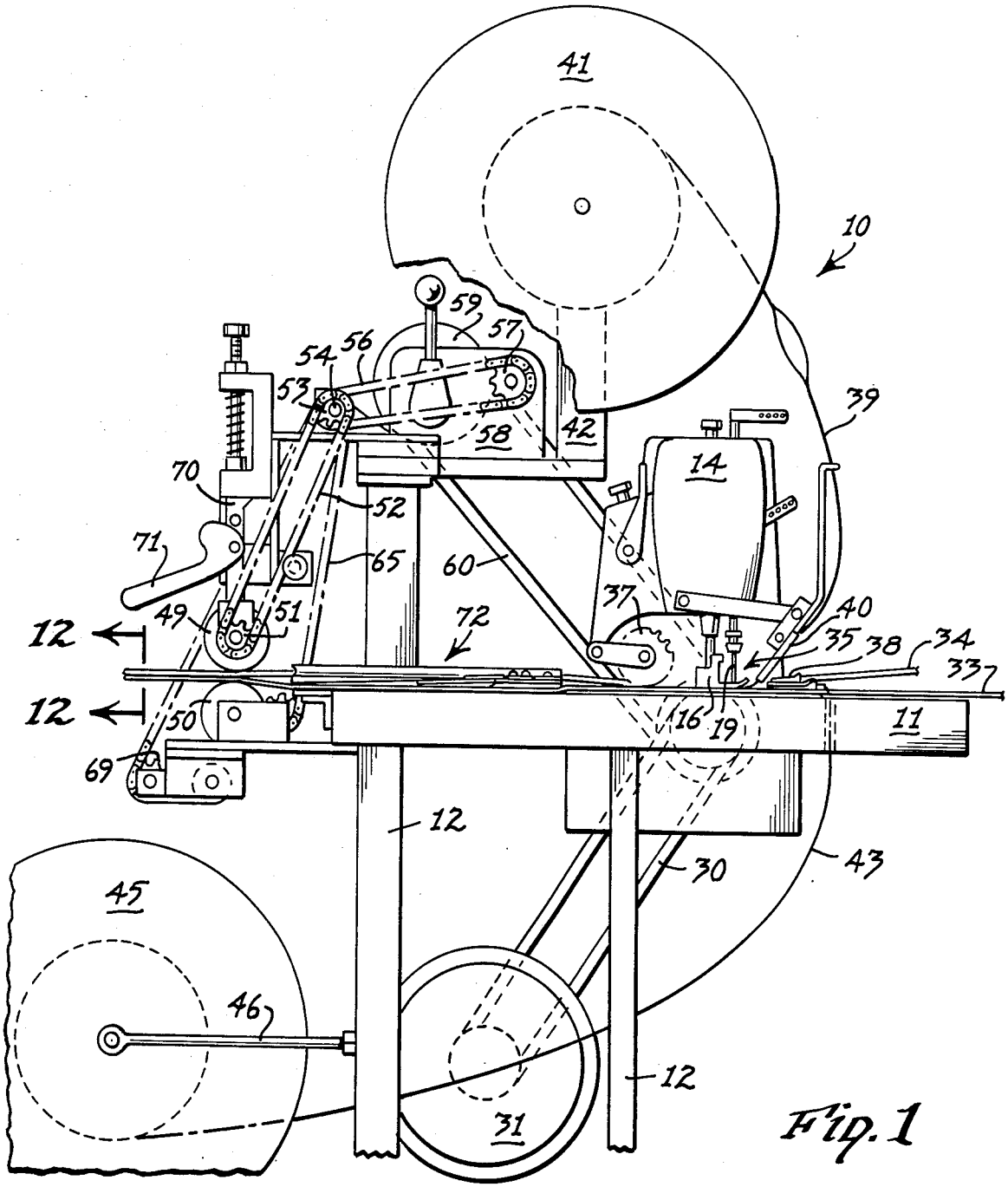
FIG. 1, is a side elevation of an apparatus for applying fastener tapes to the opposed edges of a pair of fabric pieces, and for securing the opposed fastener tapes in overlapping interlocking relationship.
Figure 2:
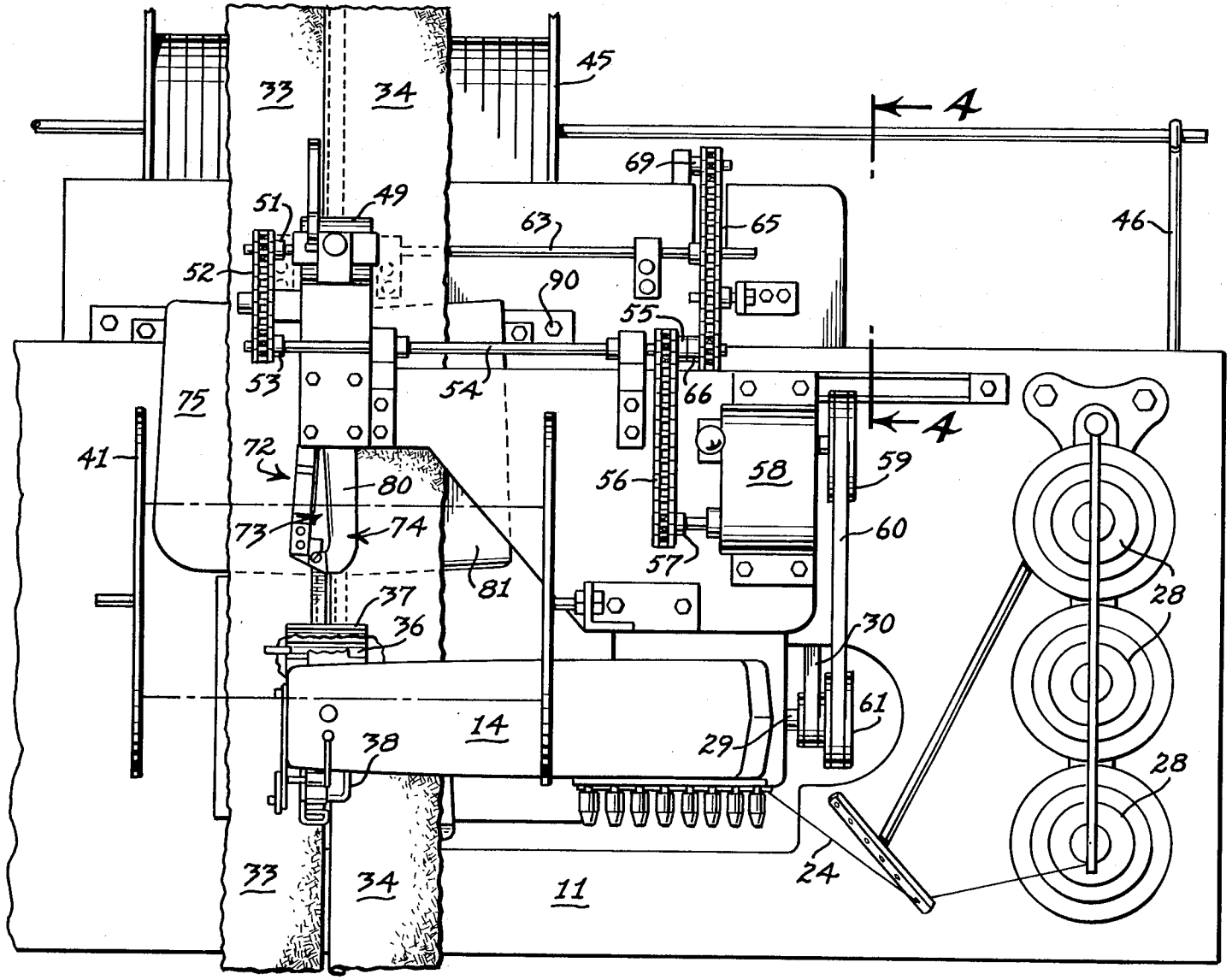
FIG. 2 is a fragmentary top plan view of the apparatus disclosed in FIG. 1.
Figure 3:
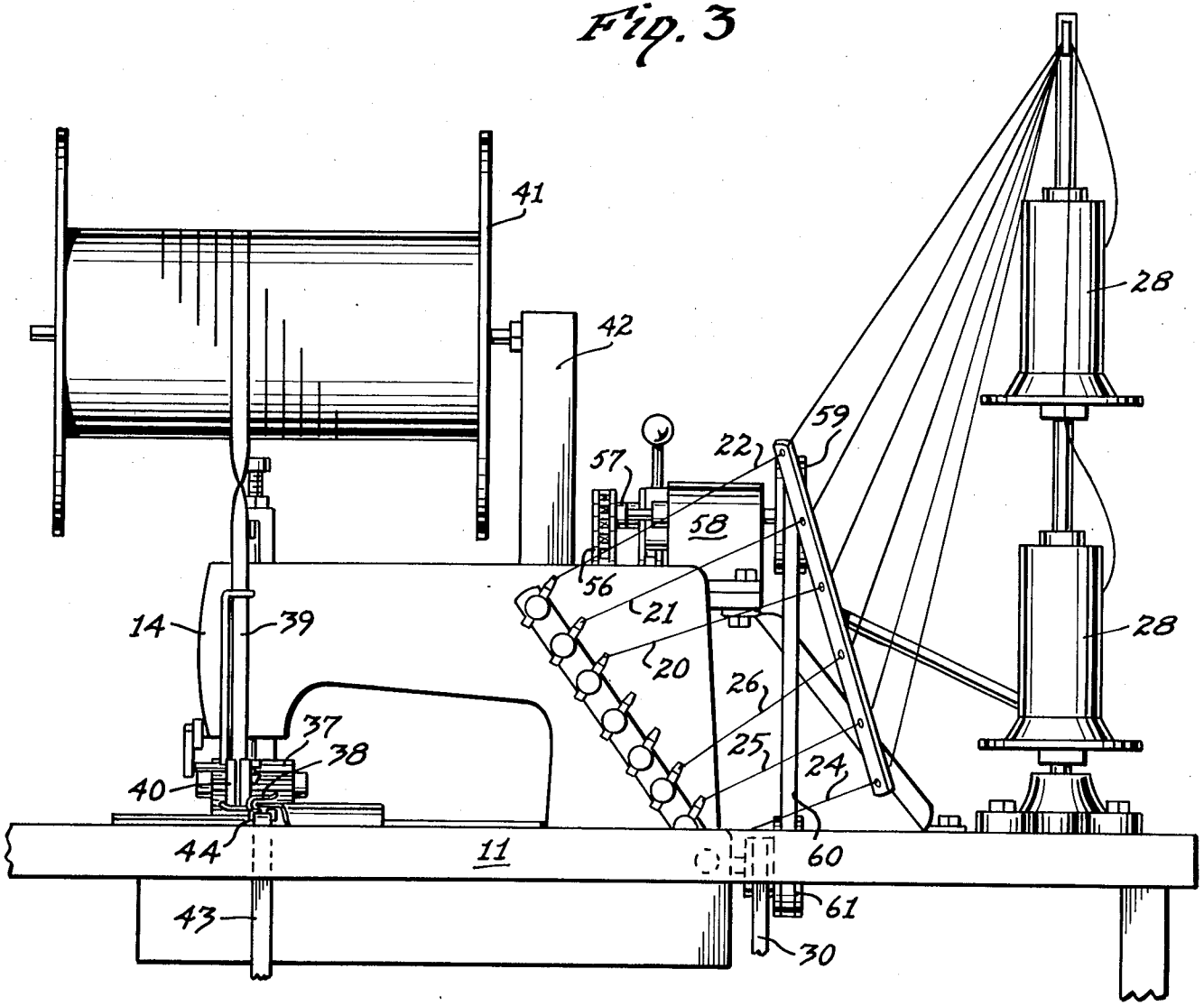
FIG. 3 is a fragmentary front elevation of the apparatus disclosed in FIG. 1.

Referring now to the drawings in more detail, FIGS. 1, 2, and 3 disclose an apparatus 10 made in accordance with this invention, including a table 11 supported by legs 12 above a floor or ground surface, not shown.

Figures 5, 6, 7, 8, 9, 10, 11:
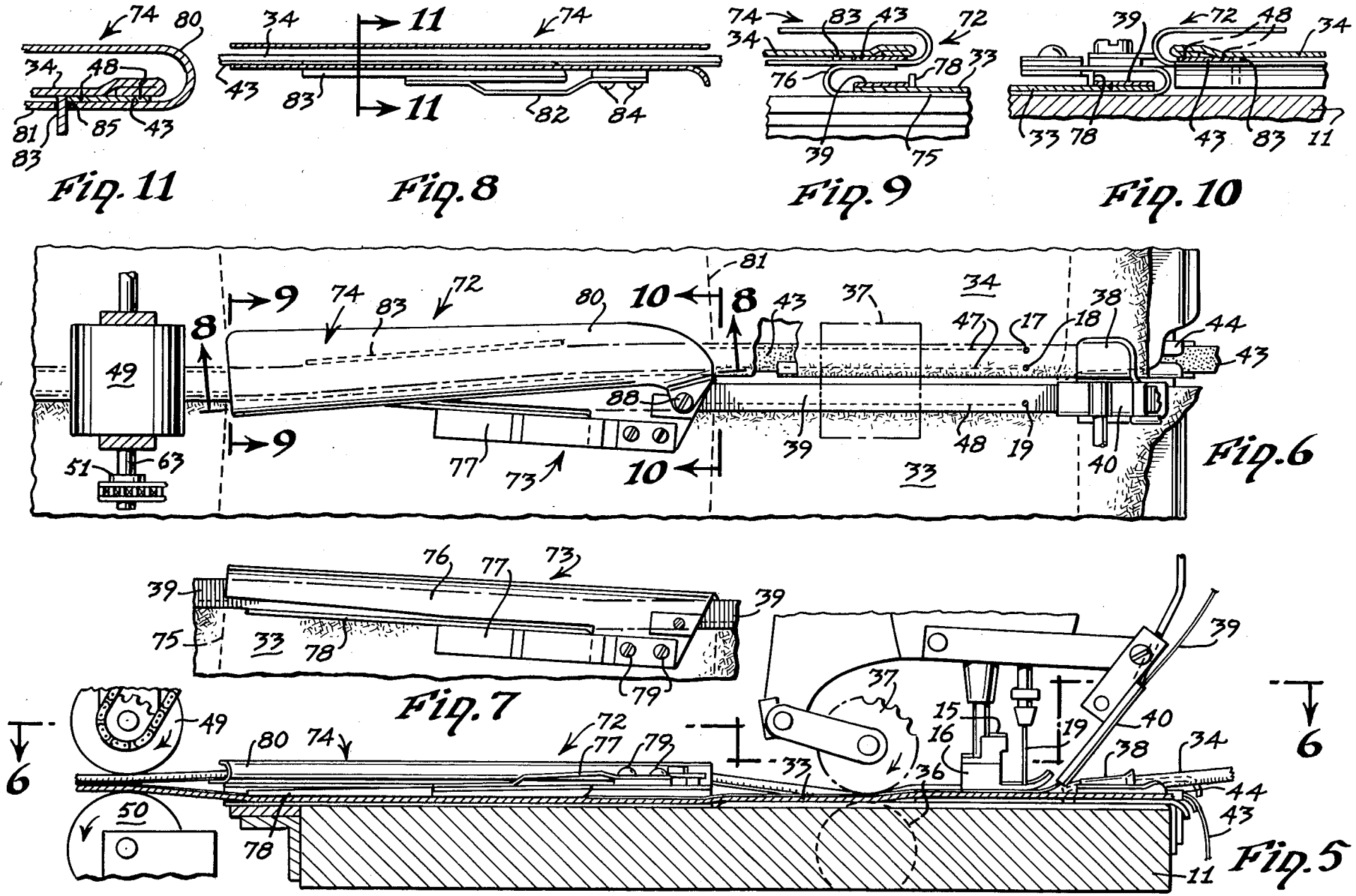
FIG. 5 is an enlarged, fragmentary sectional elevation of the stitching, guiding and pulling elements disclosed in FIG. 1, operating upon the fabric pieces.
FIG. 6 is a fragmentary sectional plan view taken along the line 6—6 of FIG. 5.
FIG. 7 is a fragmentary plan view of the lower guide member guiding one of, the fabric pieces.
FIG. 8 is a fragmentary, sectional elevation of the upper guide member, taken along the line 8—8 of FIG. 6.
FIG. 9 is an enlarged fragmentary section taken along the line 9—9, of FIG. 6.
FIG. 10 is an enlarged fragmentary section taken along the line 10—10 of FIG. 6.
FIG. 11 is an enlarged fragmentary section taken along the line 11—11 of FIG. 8.

Mounted on the front portion of the table 11 and extending transversely thereof is a sewing machine or sewing head 14, having a pair of laterally spaced presser feet 15 and 16 (FIG. 5). The presser foot 15 cooperates with a pair of transversely spaced needles 17 and 18, while the presser foot 16 cooperates with the needle 19 transversely spaced from the needles 17 and 18. Each of the needles 17, 18 and 19 is supplied with a corresponding thread 20, 21 and 22 (FIG. 3). The loopers, not shown, beneath the needle plate of the sewing head 14 are supplied with corresponding looper threads 24, 25 and 26 (FIG. 3), so that the cooperating loopers and needles 17, 18 and 19 form chain stitches in a conventional manner. The threads 20, 21, 22, 24, 25 and 26 are supplied from spools 28.

The sewing head or sewing machine 14 is driven in a conventional manner through the drive shaft 29 and belt transmission 30 from the motor 31 (FIGS. 1 and 2).

A pair of opposed fabric pieces 33 and 34 are fed through the sewing station 35, defined by the needles 17, 18 and 19, by a pair of first puller rollers 36 and 37. The lower puller roller 36, (disclosed in FIG. 2) is driven, and is a conventional part of the chain stitch sewing machine 14. The upper roller 37 is an idler roller. The fabric pieces 33 and 34 are fed through the sewing station 35 in substantially the same plane with their opposed edges slightly spaced apart.

In a preferred form of the invention, the raw edge of the fabric piece 34 is turned under by the folder flange 38 to form a smooth edge or hem, as disclosed in FIGS. 6, 9, 10, 11 and 12.

Just before the fabric piece 33 moves through the sewing station 35, an elongated fastener tape 39, such as a "Velcro" tape having monofilament hook elements, is fed through a tape guide 40 to lie flush against the top surface of the fabric piece 33 adjacent its raw edge, and with its cooperative interlocking hook surface facing upward. The fastener tape 39 is fed from a supply roll or spool 41, mounted on bracket 42 above the sewing head 14.

In a similar manner, an elongated fastener tape 43 having a gripping surface adapted to cooperate with the interlocking surface of the tape 39, such as "Velcro" tape having amyriad of tiny loops, is fed through guide 44 and beneath the hemmed edge of the fabric piece 34. The fastener tape 43, is fed from a supply spool 45 mounted below the table 11, and preferably mounted upon the leg 12 by bracket 46.

As the fabric pieces 33 and 34 and the fastener tapes 39 and 43 move through the sewing station 35 in their assembled position, the two needles 17 and 18 stitch a pair of parallel stitches 47 through the hemmed edge of the fabric piece 34 and simultaneously through the fastener tape 43. (FIGS. 6 and 12) Also, simultaneously, the single needle 19 sews a stitch 48 through the fastener tape 39 and the corresponding edge of the fabric piece 33, as best disclosed in FIGS. 6 and 12.

The puller rollers 36 and 37 not only feed both fabric pieces 33 and 34 and the tapes 39 and 43 through the sewing station 35, but also maintain the fabric pieces 33 and 34 in substantially the same plane and in proper alignment and spacing from each other.

Spaced substantially downstream of the first set of puller rollers 36 and 37, is a second or trailing set of puller or draw rollers 49 and 50 mounted for rotation about horizontal axes extending transversely of the feed paths of the fabrics 33 and 34, and also mounted one above the other in a vertical relationship. Both draw rollers 49 and 50 are positively driven in opposite directions at the same speed.

The upper draw roller 49 is driven through a transmission, including a coaxial sprocket 51 and chain 52 mounted about an upper sprocket 53. The sprocket 53 is at one end of a shaft 54>supporting at its opposite end another sprocket 55 about which is trained a chain 56, also trained about an output sprocket 57 of a gear reducer 58. The gear reducer 58 is driven by an input pulley 59 about which is trained a belt 60 driven by pulley 61, mounted coaxially of the sewing machine drive shaft 29.

Figure 4:
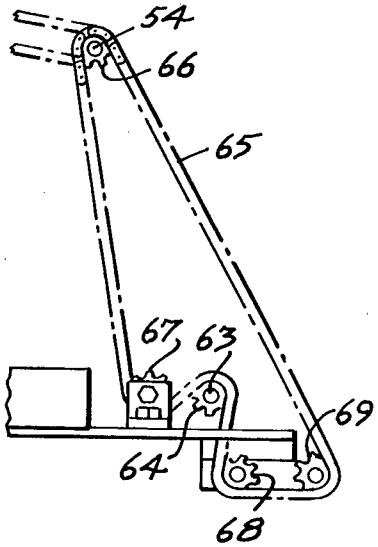
FIG. 4 is a fragmentary section taken along the line 4—4 of FIG. 2.

The lower puller or draw roller 50 is fixed to roller shaft 63, the opposite end of which is fixed to sprocket 64. Sprocket 64, in turn, is driven by an endless chain 65, which is driven by sprocket 66, fixed to shaft 54. The chain 65 is also trained about the idler sprockets 67, 68 and 69 (FIG. 4).

The upper puller or draw roller 49 is mounted on a vertically adjustable frame 70 so that it may be raised or lowered by the lift lever 71, when desired, for releasing or gripping the overlapping fabric pieces 33 and 35.

Located between the first and second sets of puller rollers 37 and 49, is a guide mechanism 72. The guide mechanism 72, includes a lower guide member 73 and an upper guide member 74.

The lower guide member 73 is made from a relatively large piece of sheet steel curved back upon itself to form a large bottom wall or plate 75 and a horizontally disposed U-shaped channel 76, which forms a bight or closed edge portion to receive and guide the edge of the fabric piece 33 and the fastener tape 39. The lower guide member 73 is arranged in a longitudinal direction to guide the fabric piece 33 and its attached tape 39 from its position under the puller roller 37 toward the puller rollers 49 and 50, as best disclosed in FIG. 7. The lower guide member 73 is preferably fixed upon the table 11 in the desired angular location for guiding the edge of a fabric piece 33 between the puller rollers 49 and 50.

As best disclosed in FIG. 7, an elongated spring finger 77 supporting an elongated guide flange 78 is fixed at its front or leading end by screws 79, to a laterally projecting upper portion of the channel 76. The purpose of the guide flange 78, which is biased downward against the bottom plate 75 by the spring member 77, is to abut against the inner edge of the tape 39, while resting upon the top surface of the fabric piece 33. In this manner, the tape 39 is confined between the guide flange 78 and the bight of the channel 76, in order to accurately maintain the longitudinal movement of the fabric piece 33 in its feed direction determined by the angular direction of the lower guide member 73.

The upper guide member 74 has a similar construction to the lower guide member 73, having a turned up edge which reverses itself to form a horizontally disposed U-shaped channel 80, opening in the opposite direction from the channel 76. The upper guide member 74 also has a lower or bottom wall 81, which merges with the channel 80. The bight portion of the channel 80 provides a guide or outer abutment for the hemmed edge of the fabric piece 34 and its attached fastener tape 43.

Mounted on the bottom wall 81 of the upper guide member 74, is an elongated spring finger 82, to which is fixed an elongated guide flange 83. The spring finger 82 is fixed to the bottom wall 81 by the screws 84, as best disclosed in FIGS. 8 and 11. The guide flange 83 is adapted to be biased upward through an elongated slot 85 formed within the bottom wall 81 and adapted to form an inner guide to abut against the inner edge of the fastener tape 43, when the hemmed edge of the fabric piece 34 is contained within the channel 80, as best disclosed in FIGS. 6, 8, 9, 10 and 11.

Thus, the spacing between the bight portion of the channel 76 and the guide flange 78, is slightly greater than the width of the fastener tape 39, while the spacing between the bight portion of the channel 80 and the guide flange 83 is likewise, slightly greater than the width of the fastener tape 43. Thus, accurate control can be maintained over the feed direction of the respective edges of the fabric pieces 33 and 34 by guiding their corresponding tapes 39 and 43.

Also, in a preferred form of the invention, the upper guide member 74 is pivotally mounted above the lower guide member 73 by means of a pivot or journal pin 88. Thus, the upper guide member 74 may, by loosening the pivot pin 88, be manually adjusted to obtain the correct or desired convergent angles or attitudes between the upper guide member 74 and the lower guide member 73. After the upper guide member 74 is properly adjusted, it guides the hemmed edge 34 from its substantial co-planar position with the fabric piece 33 from the puller rollers 36 and 37 upward and over the fabric piece 33, until the tape 43 is vertically aligned above the tape 39 at the trailing rear or discharge ends of the respective guide members 74 and 73. From these vertically aligned overlapping positions, the fastener tapes are carried with their cooperating faces opposing each other, one above the other, beneath the puller rollers 49 and 50. The puller rollers 49 and 50 then compress both fastener tapes 39 and 43 together, with their hooks and loops interlocking to secure the edges of the fabric pieces 33 and 34 together. The interlocked positions of the overlapping hemmed edge of the fabric piece 34 and the lower fabric 33 is disclosed in FIG. 12, with the cooperative faces of the respective tapes 43 and 39 firmly secured together.

Normally, the upper guide member 74 will remain in its originally pivotally adjusted position, relative to the lower guide member 73. However, when the thickness or width of the fabric pieces 33 and 34 vary, then slight adjustments in the angular position of the upper guide member 74 relative to the lower guide member 73 may be made.

When the upper guide member 74 is pivotally adjusted, the bolt 90 (FIG. 2) may be loosened and shifted in an elongated slot, not shown, in order to permit the bottom wall 81 of the upper member 74 to be shifted.

It will therefore be seen that an apparatus 10 has been developed for simultaneously stitching the opposing fastener tapes 39 and 43 to the corresponding edges of a pair of fabric pieces 33 and 34, and also to guide these edges with their stitched tapes in converging overlapping paths for vertical alignment of the opposed cooperative faces of the tapes, and compressing the fabric pieces 33 and 34 to lock these edges in overlapping relationship for further processing. In one form of the invention, the fabric pieces 33 and 34 with their locked tapes, which hold the pieces 33 and 34 together in proper alignment and relationship, can be stitched to additional fabric panels in order to produce a sofa cushion cover, for example.

A sofa cushion cover having an elongated opening in the edge thereof, for insertion and removal of the cushion, can now include interlocking fastener tapes, such as "Velcro" tapes, which are more easily separated and closed, than are conventional slide fasteners, such as "zippers".

What is claimed is:

1. An apparatus for securing a pair of fastener tapes, having cooperative faces, to a pair of fabric pieces, each piece having a longitudinal edge, and to each other, comprising:

(a) applicator means for securing a first elongated fastener tape face up to a first fabric piece along the longitudinal edge of said first fabric piece, and for securing a second elongated fastener tape face down to a second fabric piece along the longitudinal edge of said second fabric piece, at an applicator station, said applicator means having front and rear portions, (b) first guide means for guiding said first and second fabric pieces, during movement of said fabric pieces in a longitudinal rearward direction through said applicator station, and in a substantially coplanar position in which the longitudinal edges of said fabric pieces oppose each other.

(c) second guide means for guidings said first fastener tape above said first fabric piece and along the longitudinal edge of said first fabric piece, and guiding said second fastener tape below said second fabric piece and along the longitudinal edge of said second fabric piece, during movement of said fastener tapes in said longitudinal rearward direction through said applicator station, (d) rear guide means for guiding said first and second fabric pieces away from said applicator station, said rear guide means being spaced longitudinally rearward of said applicator station and including a lower rear elongated guide member and an upper rear elongated guide member, each of said guide members having front and rear end portions, and each of said guide members comprising an elongated guide element, each guide element being on a longitudinal side of its respective guide member, said guide elements limiting edgewise movement of the fabric pieces guided by said guide members, (e) mounting means mounting said upper rear guide member above and at an angle to said lower rear guide member, said front end portions being spaced transversely of each other relative to said longitudinal direction, and said rear end portions being in substantial vertical alignment with each other, (f) draw means for pulling said first and second fabric pieces into an overlapping relationship from said rear end portions of said lower and upper guide members with said first and second fastener tapes having their opposing cooperative faces in substantially vertical alignment with each other, and for compressing said fastener tapes together to secure said cooperative faces in cooperative engagement, said draw means being behind said rear end portions of said upper and lower guide members.

2. The invention according to claim 1 in which each guide element comprises an elongated horizontally disposed channel, each channel including a closed portion facing away from the closed portion of the other channel to engage the edges of the first and second fabric piece.

3. The invention according to claim 2 in which each of said guide members further comprises a guide flange spaced from the closed portrion of its corresponding channel a distance that is slightly greater than the width of a fastener tape secured to the fabric piece carried through its corresponding channel, and means mounting each of said guide flanges in its corresponding guide member to abut against an inner edge of a fastener tape.

4. The invention according to claim 3 in which said means mounting said guide flanges comprise spring means biasing each flange toward a fabric piece carried by a corresponding guide member.

5. The invention according to claim 1 in which said mounting means comprises means pivotally mounting said upper guide member for sustantially horizontal pivotal movement relative to said lower guide member in order to vary the angle between said upper and lower guide members.

6. The invention according to claim 1 in which said draw means comprises a pair of positively driven upper and lower draw rollers mounted about vertically spaced, parallel, horizontal axes, and means for driving said draw rollers to pull both said first and second pieces through said draw rollers to compress said first and second fastener tapes into said cooperative engagement.

7. The invention according to claim 1 further comprising a pair of puller rollers mounted behind said applicator station, and means for driving said puller rollers to pull said fabric pieces and said fastener tapes secured to said fabric pieces through said applicator station in said coplanar position.

8. The invention according to claim 1 in which said applicator means comprises a sewing head including reciprocable needles for stitching said first fastener tape to said first fabric piece, and said second fastener tape to said second fabric piece.

* * * * *